US007322155B2

(12) United States Patent
Gerep

(10) Patent No.: US 7,322,155 B2
(45) Date of Patent: Jan. 29, 2008

(54) STUD WITH HEAT SINK

(75) Inventor: Marcio Gerep, Chattanooga, TN (US)

(73) Assignee: Sage of America, Inc., Ooltewah, TN (US)

( * ) Notice: Subject to any disclaimer, the term of this patent is extended or adjusted under 35 U.S.C. 154(b) by 672 days.

(21) Appl. No.: 10/781,274

(22) Filed: Feb. 18, 2004

(65) Prior Publication Data

US 2004/0163349 A1 Aug. 26, 2004

Related U.S. Application Data

(60) Provisional application No. 60/448,006, filed on Feb. 18, 2003.

(51) Int. Cl.
*E04H 14/00* (2006.01)

(52) U.S. Cl. ..... 52/173.1

(58) Field of Classification Search ..... 52/379, 52/506.02, 513, 698, 740.6, 173.1; 126/144; 432/214, 247, 249, 258, 259; 110/317
See application file for complete search history.

(56) References Cited

U.S. PATENT DOCUMENTS 2,077,410 A * 4/1937 Cassidy et al. ..... 122/6 A
2,239,662 A * 4/1941 Bailey ..... 122/6 A
3,301,300 A 1/1967 Natter
3,313,339 A * 4/1967 Coe ..... 165/80.3
3,657,851 A 4/1972 Chambers et al.
3,801,357 A 4/1974 Baldl
4,139,975 A 2/1979 Baker
4,157,001 A 6/1979 Pickles
4,414,674 A * 11/1983 Woodruff et al. ..... 373/130
4,680,908 A 7/1987 Crowley
4,884,331 A * 12/1989 Hinshaw ..... 29/558
5,107,798 A 4/1992 Gerep
5,366,817 A 11/1994 Oden et al.
5,590,712 A * 1/1997 Fisher et al. ..... 165/185
5,912,050 A 6/1999 Zeigler et al.
6,197,125 B1 3/2001 Kung
6,238,489 B1 5/2001 Lundell
6,387,194 B1 5/2002 Zeigler et al.
6,440,499 B1 * 8/2002 Wydra et al. ..... 427/376.8
6,563,855 B1 5/2003 Nishi et al.

OTHER PUBLICATIONS

IBM Technical Disclosure Bulletin, Sep. 1969, "Selective Carburization Technique".

* cited by examiner

*Primary Examiner*—Richard E. Chilcot, Jr.
*Assistant Examiner*—Jessica Laux
(74) *Attorney, Agent, or Firm*—Buchanan Ingersoll & Rooney PC

(57) ABSTRACT

A stud of the type attached to a furnace wall or boiler tube has a plurality of projections extending from the top of the stud which act as a heat sink. The projections also have a corrosion or erosion resistant coating such as a chromium diffusion layer. The stud as well as the furnace wall or boiler tube to which they are attached will have a longer service life.

25 Claims, 1 Drawing Sheet

STUD WITH HEAT SINK

CROSS REFERENCE TO RELATED APPLICATION

This application claims priority from U.S. Provisional Patent Application Ser. No. 60/448,006, filed Feb. 18, 2003.

FIELD OF INVENTION

The invention relates to studs attached to the walls of boiler tubes and furnaces to act as heat conductors or to support refractory concrete and other insulating layers applied to the walls.

DESCRIPTION OF PRIOR ART

Metal studs also known as bolts and anchoring elements are slender metal pieces applied on metal surfaces to provide a means to keep in place on furnace walls different sorts of insulating materials. Insulating media can be applied by hammering, pouring and other means. One of the most common methods of application of such studs is the stud welding process, but studs may be applied by other means such as many different welding processes, thread, clamps and others.

Studs behave as fins in the sense they collect heat from the combustion chamber and allow this heat to flow towards the element to which they are connected. When the equipment is in operation, the stud tip is the most severely affected part of the stud. It is the hottest point, and therefore the tip is the first point in the stud to collapse under high temperature and other surrounding conditions. Those other conditions could be impact by solid particles of fuel, corrosion or sometimes erosion caused by slag touching the stud. Regardless of what combination of factors act on the stud, the destruction of a stud starts at its tip.

There is a need for a stud having an improved tip that will better resist the conditions that cause the studs to deteriorate. Preferably, the tip will better resist both corrosion and erosion. A stud having such an improved tip will have a longer useful life.

SUMMARY OF THE INVENTION

I provide an improved stud with a serrated tip, which naturally forms a heat sink element at its tip. The serrations can be of any desired shape and pattern but preferably are formed by a grid pattern of cross cuts.

I further prefer to provide a coating on the tip that resists corrosion and erosion. Preferably this coating is a chromium diffusion layer. However, other corrosion resistant and erosion resistant materials could be used. The diffusion layer need not be limited to the tip. Indeed. I prefer that at least the upper portion of the side of the stud also have a diffusion layer.

Other objects and advantages of the invention will become apparent from the description of certain present embodiments shown in the figures.

DESCRIPTION OF THE PREFERRED EMBODIMENTS

Figure 1:
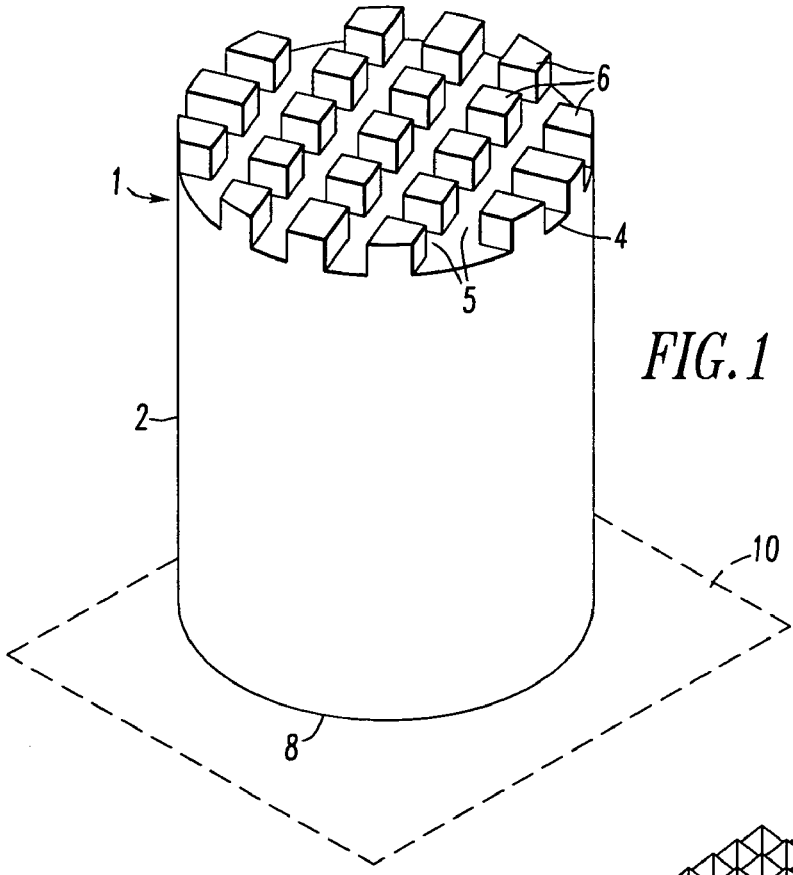
FIG. 1 is a perspective view of a present preferred stud.

As shown in FIG. 1 a first present preferred stud 1 has a generally cylindrical body having a side 2 that extends from the top 4 to the bottom 8 of the stud. The bottom of the stud may be attached to a furnace wall, boiler wall, boiler tube or a replacement panel for a furnace or boiler. A portion of these surfaces 10 is shown in dotted line. A series of cross-cut grooves 5 are provided in the top which define a series of projections 6 creating a serrated tip. The projections naturally form heat sink elements at the tip of the stud. The serrations can be of any desired shape and pattern but preferably are formed by a grid pattern of cross cuts. The indentations can be made during the cold forming process of manufacturing the studs or can be introduced after the stud is manufactured using roll threading, machining, subsequent cold forming or other techniques. Although the stud is illustrated as having a circular cross-section other shapes including an oval or polygon cross-section could be used. A corrosion resistant coating is applied at least a portion of the stud including the serrated tip. This coating preferably is a chrome layer applied by a diffusion process, such as pack cementation. The coating may contain other elements and combinations commonly used in corrosion resistant coatings to improve corrosion resistance and physical properties. The studs can be any desired length and made of low carbon steel or other metal alloy of the type used for conventional studs. The stud could also be a jacketed stud of the type disclosed in U.S. Pat. No. 5,107,798.

The stud shown in FIG. 1, with or without being jacketed, is particularly useful in pulp mill recovery boilers which are particularly corrosive environments. Other applications include waste disposal incinerators which can be of similar construction. In such incinerators abrasive particles and various solid materials may be directed towards the water tubes. Other examples are oil- or coal-fueled cyclone boilers for power generation, and various types of furnaces used in industrial processes.

Figure 2:
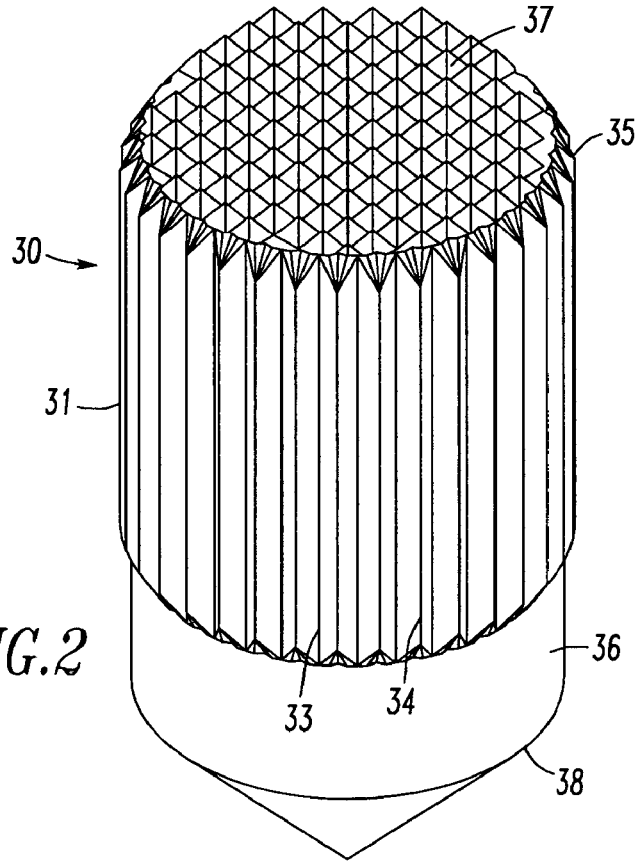
FIG. 2 is a perspective view of a second present preferred stud.

A second present preferred embodiment of my stud is shown in FIG. 2. This stud 30 has a generally cylindrical body 31 with a series of grooves 33 and ridges 34 extending from the top 35 of the stud. The grooves 33 and ridges 34 do not extend the full length of the stud. There is a smooth section 36 near the bottom 38 of the stud. This smooth section serves as a warning to the user. When the upper portion of the stud has worn down to the smooth section, it is time to replace the stud. The conical bottom 38 of the stud is welded to a furnace wall. The conical shape minimizes the amperage required to weld the stud to a furnace wall. The top 35 of the stud 30 has a series of projections 37. These projections are different in shape from the projections 5 in the embodiment of FIG. 1, but they function in the same way. A diffusion coating is applied to the top of the stud. That same coating is also applied to the grooves 33 and ridges 34.

Studs on furnace wall, boiler tubes and furnace panels may be subjected to hot liquids, and/or hot gasses. Solid particles or objects, such as milled coal or fragments of slag or refractory material that have broken loose, may strike the studs. In cases where a stud in accordance with the present invention is exposed to a liquid, the liquid will undergo an effective cooling before it touches the portion of the stud beneath the heat sink elements. In some cases this temperature drop will be sufficient to solidify the liquid in contact with the stud thus providing a frozen layer that insulates the upper portion of the stud from the worst surrounding conditions.

In cases where the stud made in accordance with the present invention is exposed to a gas, the heat transfer to the main portion of that stud (right below the heat sink elements) will be much more uniform than in the prior art studs in which the edges of the stud tip received more heat than all other points forming the tip. The present design equalizes the conditions at the stud tip and will minimize the stresses there. Such stress in studs of the prior art resulted in accelerated wear at the edges of the tip.

There are gaps in the tip of studs made in accordance with the present invention. In cases where the present stud is exposed to impact of solid particles the gaps between the indentations will cause a much higher stress to the incoming solid particles. Generally the higher stress in an impacting particle will break the particle into smaller pieces before the particle hits the surface of the stud below the heat sink. Finer particles of the broken larger particles will be trapped in between the indentations or grooves thus forming an insulating solid layer between the stud tip and the incoming particles.

Summarizing, the stud tips in studs made in accordance with the present invention will usually be insulated against the worse conditions existing in its surrounding due to the interference of the heat sink elements. The serrated surface of the tip together with the coating on the tip give the present stud improved performance and longer life. Without an additional surface enhancement the teeth or indentations would quickly collapse under the intense attack of solids, liquids and gasses that are present in a furnace or boiler.

I prefer that the stud have a layer of anti-abrasion elements and anti-corrosion elements, that have been applied to at least the tip, preferably by diffusion. In the diffusion process the higher the temperature the higher the diffusion rate is. During the diffusion process, on the tip of the stud will heat more quickly than the remainder of the stud and due to the heat sink effect of the indentation. Consequently, the projections will start absorbing the enhancing elements before all other parts of the stud. During the diffusion process, heat itself will clearly define and at the same time promote the diffusion of the protective elements to the affected parts of the stud.

For this reason, the indentations or grooves at the stud tip will always have a higher diffusion rate than the rest of the stud so that the diffusion coating will be thicker at the tip than on the side of the stud. The heat sink on the tip of the stud assures that diffusion will be more effective in the points more subject to high temperatures when the equipment operates. The diffusion coating layer is always much thicker at the tip. Therefore, the stud made in accordance with the present invention will be more apt to withstand the harsh conditions. Furthermore, such studs minimize the attack to the portion of the stud below the heat sink elements. In experiments run by the applicant, life cycle increases greater than 100% were obtained.

One preferred coating is made using pack cementation deposition. For a chromium coating the pack mix should contain an inert material such as aluminum oxide, a chromium source such as ferrochrome, and an activator such as ammonium chloride. One suitable composition is 55% aluminum oxide, 42% ferrochrome and 3% ammonium chloride.

The diffusion coating is not limited to chromium but could be any material used to provide corrosion resistance, strength or other desired properties. In the particular case of recovery boilers used in the pulp industry better results were achieved by diffusion of chromium only. In the case of cyclone boilers used in the power generation industry better results were achieved with the co-diffusion of chromium and cobalt or chromium and boron, i.e. one element to enhance the corrosion protection and another to enhance the abrasion resistance. The coating material should be selected according to the combustion products, chemicals or particles to which the studs will be exposed. Suitable coatings could be made from chromium, aluminum, nickel, cobalt, silicon, boron, rhenium, and zinc as well as carbides, nitrides and oxides thereof.

While the preferred embodiments are illustrated as cylindrical studs, the present invention is not so limited. The term stud is here used to encompass any structure that extends from the wall of a furnace or boiler to transfer heat or support a refractory or insulating material. Furthermore, what has been here described as the tip could be an exposed edge of an elongated structure such as a fin or other component found on a furnace wall or boiler wall.

The studs here disclosed may be sold individually or as part of an assembly. That assembly may be an entire furnace or boiler, a boiler wall, a furnace wall, a boiler tube or a replacement panel for a furnace wall or boiler. Typically such assemblies will have a longer service life than a comparable assembly having conventional studs.

Although I have described and illustrated certain present preferred embodiments of my stud with heat sink it is to be distinctly understood that the invention is not limited thereto, but may be variously embodied within the scope of the following claims.

I claim:

1. An improved stud of the type attached to a furnace wall or boiler tube comprised of a cylindrical body having a top, a bottom and a side wall extending from the top to the bottom, wherein the improvement comprises a plurality of projections extending from the top of the stud, the projections sized and configured to form a heat sink.

2. The improved stud of claim 1 also comprising a diffusion coating applied to the projections.

3. The improved stud of claim 2 wherein the diffusion coating contains at least one of chromium, aluminum, nickel, silicon, boron, rhenium, zinc and carbides, nitrides and oxides thereof.

4. The improved stud of claim 1 also comprising a corrosion resistant or erosion resistant coating applied to at least a portion of the body of each stud.

5. The improved stud of claim 1 wherein the plurality of projections are formed by a series of cross cuts on the top of the stud.

6. The improved stud of claim 1 wherein the side wall is comprised of a plurality of grooves extending from the top toward the bottom of the cylindrical body.

7. The improved stud of claim 1 wherein the body has a cross-sectional shape selected from the group consisting of a circle, an oval and a polygon.

8. An improved furnace of the type having studs attached to a wall of the furnace wherein the improvement comprises at least some of the studs comprised of a cylindrical body having a top, a bottom, a side wall extending from the top to the bottom, and a plurality of projections extending from the top of the stud, the projections sized and configured to form a heat sink.

9. The improved furnace of claim 8 also comprising a diffusion coating applied to the projections.

10. The improved furnace of claim 9 wherein the diffusion coating contains at least one of chromium, aluminum, nickel, silicon, boron, rhenium, zinc and nitrides and oxides thereof.

11. The improved stud of claim 8 also comprising a corrosion resistant or erosion resistant coating applied to at least a portion of the body of each stud.

12. The improved stud of claim 8 wherein the plurality of projections are formed by a series of cross cuts on the top of the stud.

13. The improved stud of claim 8 wherein the side wall is comprised of a plurality of grooves extending from the top toward the bottom of the cylindrical body.

14. An improved replacement panel for a furnace or boiler of the type having studs attached to a surface of the panel wherein the improvement comprises at least some of the studs comprised of a cylindrical body having a top, a bottom, a side wall extending from the top to the bottom, and a plurality of projections extending from the top of the stud, the projections sized and configured to form a heat sink.

15. The improved replacement panel of claim 14 also comprising a diffusion coating applied to the projections.

16. The improved replacement panel of claim 15 wherein the diffusion coating contains at least one of chromium, aluminum, nickel, silicon, boron, rhenium, zinc and carbides, nitrides and oxides thereof.

17. The improved replacement panel of claim 14 also comprising a corrosion resistant or erosion resistant coating applied to at least a portion of the body of each stud.

18. The improved replacement panel of claim 14 wherein the plurality of projections are formed by a series of cross cuts on the top of the stud.

19. The improved replacement panel of claim 14 wherein the side wall is comprised of a plurality of grooves extending from the top toward the bottom of the cylindrical body.

20. An improved boiler of the type having studs attached to a wall of at least one boiler tube wherein the improvement comprises at least some of the studs comprised of a cylindrical body having a top, a bottom, a side wall extending from the top to the bottom, and a plurality of projections extending from the top of the stud, the projections sized and configured to form a heat sink.

21. The improved boiler of claim 20 also comprising a diffusion coating applied to the projections.

22. The improved boiler of claim 21 wherein the diffusion coating contains at least one of chromium, aluminum, nickel, silicon, boron, rhenium, zinc and carbides, nitrides and oxides thereof.

23. The improved boiler of claim 20 also comprising a corrosion resistant or erosion resistant coating applied to at least a portion of the body of each stud.

24. The improved boiler of claim 20 wherein the plurality of projections are formed by a series of cross cuts on the top of the stud.

25. The improved boiler of claim 20 wherein the side wall is comprised of a plurality of grooves extending from the top toward the bottom of the cylindrical body.

* * * * *